US009498659B2

(12) United States Patent
Schurian

(10) Patent No.: US 9,498,659 B2
(45) Date of Patent: Nov. 22, 2016

(54) VIEW PACK FOR SHOCK ABSORBING LANYARD

(71) Applicant: Alexander Andrew, Inc., Compton, CA (US)

(72) Inventor: Cortland G. Schurian, Long Beach, CA (US)

(73) Assignee: Alexander Andrew, Inc., Compton, CA (US)

( * ) Notice: Subject to any disclaimer, the term of this patent is extended or adjusted under 35 U.S.C. 154(b) by 291 days.

(21) Appl. No.: 13/792,035

(22) Filed: Mar. 9, 2013

(65) Prior Publication Data

US 2014/0251722 A1 Sep. 11, 2014

(51) Int. Cl.
*A62B 35/00* (2006.01)
*A62B 35/04* (2006.01)

(52) U.S. Cl.
CPC ..... *A62B 35/0075* (2013.01); *A62B 35/04* (2013.01)

(58) Field of Classification Search
CPC ... A62B 35/0075; A62B 35/04; F16F 7/006; F16F 7/14
USPC ..... 182/18; 383/106
See application file for complete search history.

(56) References Cited

U.S. PATENT DOCUMENTS 2,916,141 A * 12/1959 Arnot ..... 206/386
3,444,957 A * 5/1969 Gilpin, Jr. ..... 182/3
4,446,944 A * 5/1984 Forrest et al. ..... 182/3
5,090,503 A * 2/1992 Bell ..... 182/5
5,174,410 A * 12/1992 Casebolt ..... 182/3
5,333,656 A * 8/1994 Mackal ..... 141/330
6,637,485 B1 * 10/2003 Sartena ..... 150/118
6,896,131 B2 * 5/2005 Bisbal et al. ..... 206/223
6,923,302 B2 * 8/2005 Godshaw et al. ..... 190/109
7,690,503 B2 * 4/2010 Foster et al. ..... 206/223
8,584,799 B1 * 11/2013 Dennington ..... 182/3
2004/0076347 A1 * 4/2004 Johnson ..... 383/106
2005/0039980 A1 * 2/2005 Diggle et al. ..... 182/9
2005/0092546 A1 * 5/2005 Hsu ..... 182/6
2010/0116859 A1 * 5/2010 Dessou-Tzafrir et al. ... 224/409
2011/0090079 A1 * 4/2011 Morino et al. ..... 340/532
2011/0163529 A1 * 7/2011 Rossing ..... 283/70
2011/0317448 A1 * 12/2011 Podd ..... 362/628
2012/0298446 A1 * 11/2012 Meillet et al. ..... 182/15
2014/0054335 A1 * 2/2014 Morgan et al. ..... 224/222
2014/0251725 A1 * 9/2014 Schurian et al. ..... 182/3

OTHER PUBLICATIONS

Shrink Wrap PVC shown in Action <http://www.uline.com/Product/AdvSearchResult.aspx?keywords=pvc%20heat%20shrink%20&pricode=WG163&AdKeyword=pvc%20heat%20shrink&AdMatchtype=p&gclid=CNytl9eLusUCFdORHwodPn8AjA&gclsrc=aw.ds>.*

* cited by examiner

*Primary Examiner* — Alvin Chin-Shue
*Assistant Examiner* — Shiref Mekhaeil

(57) ABSTRACT

A shock absorbing view pack is permanently attached with a material cover. A first inspection window is connected to the shock absorbing view pack. The first inspection window for inspecting an absorption portion of a lanyard disposed within the shock absorbing view pack.

14 Claims, 7 Drawing Sheets

VIEW PACK FOR SHOCK ABSORBING LANYARD

BACKGROUND

Field

The embodiments relate to fall protection devices, and in particular to viewable shock absorbing pack for lanyards.

Description of the Related Art

Workers that work in elevated environments may employ fall protection gear, such as a fall protection harness and lanyard. The current shock absorbing packs for lanyards do not allow for internal inspection within the pack. FIG. 1 shows an example shock absorbing system 100 including a shock absorbing pack 110. As can be seen in FIG. 1, the shock absorbing pack 110 does not allow for internal inspection.

SUMMARY

One embodiment of the invention provides a shock absorbing view pack is permanently attached with a material cover. A first inspection window is connected to the shock absorbing view pack. The first inspection window for inspecting an absorption portion of a lanyard disposed within the shock absorbing view pack.

Another embodiment of the invention provides a fall protection assembly includes a shock absorbing view pack permanently coupled with a material cover and a lanyard. The shock absorbing pack including a first inspection window coupled to a first side of the shock absorbing view pack. A first lanyard coupler is coupled to a first end of the lanyard in proximity to a first end of the shock absorbing pack. A second lanyard coupler is coupled to a second end of the lanyard. A second end of the shock absorbing pack is coupled to another portion of the lanyard.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of fall protection shock absorbing view pack systems and devices, as well as operation and/or component parts thereof. While the following description will be described in terms of fall protection shock absorbing view pack systems and devices for clarity and to place the invention in context, it should be kept in mind that the teachings herein may have broad application to all types of systems, devices and applications.

One embodiment of the invention provides a shock absorbing view pack is permanently attached with a material cover. A first inspection window is connected to the shock absorbing view pack. The first inspection window for inspecting an absorption portion of a lanyard disposed within the shock absorbing view pack.

Figure 1:
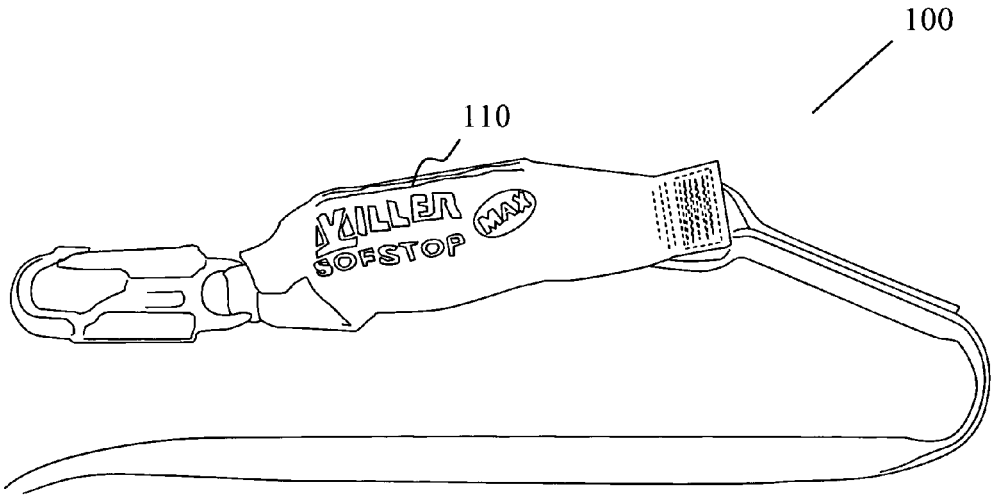
FIG. 1 (prior art)
FIG. 1 illustrates a prior art shock absorbing pack connected to a lanyard.
Figure 2:
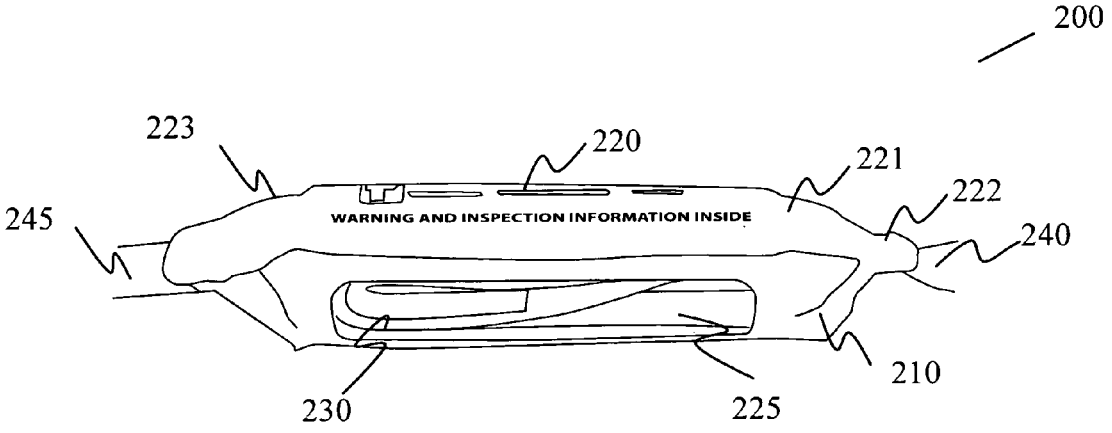
FIG. 2 illustrates a perspective view of an actual viewable shock absorbing pack for a lanyard according to one embodiment of the invention.

FIG. 2 illustrates a perspective view of a shock absorbing view pack 200 for a lanyard according to one embodiment of the invention. In one example, the shock absorbing view pack 200 includes a material cover 210 permanently attached to the view pack. One embodiment of the invention includes a first inspection window 227 (FIG. 7) coupled to the shock absorbing view pack 200, where the first inspection window 227 may be used for inspecting an absorption portion 230 of a lanyard disposed within the shock absorbing view pack 200.

In one embodiment of the invention, the material cover 210 may be made of a soft material, such as nylon, cotton, material blends (e.g., nylon/cotton), etc. In one example, padding may be included underneath or within the material cover 210 for added protection from impact with a user.

Figure 7:
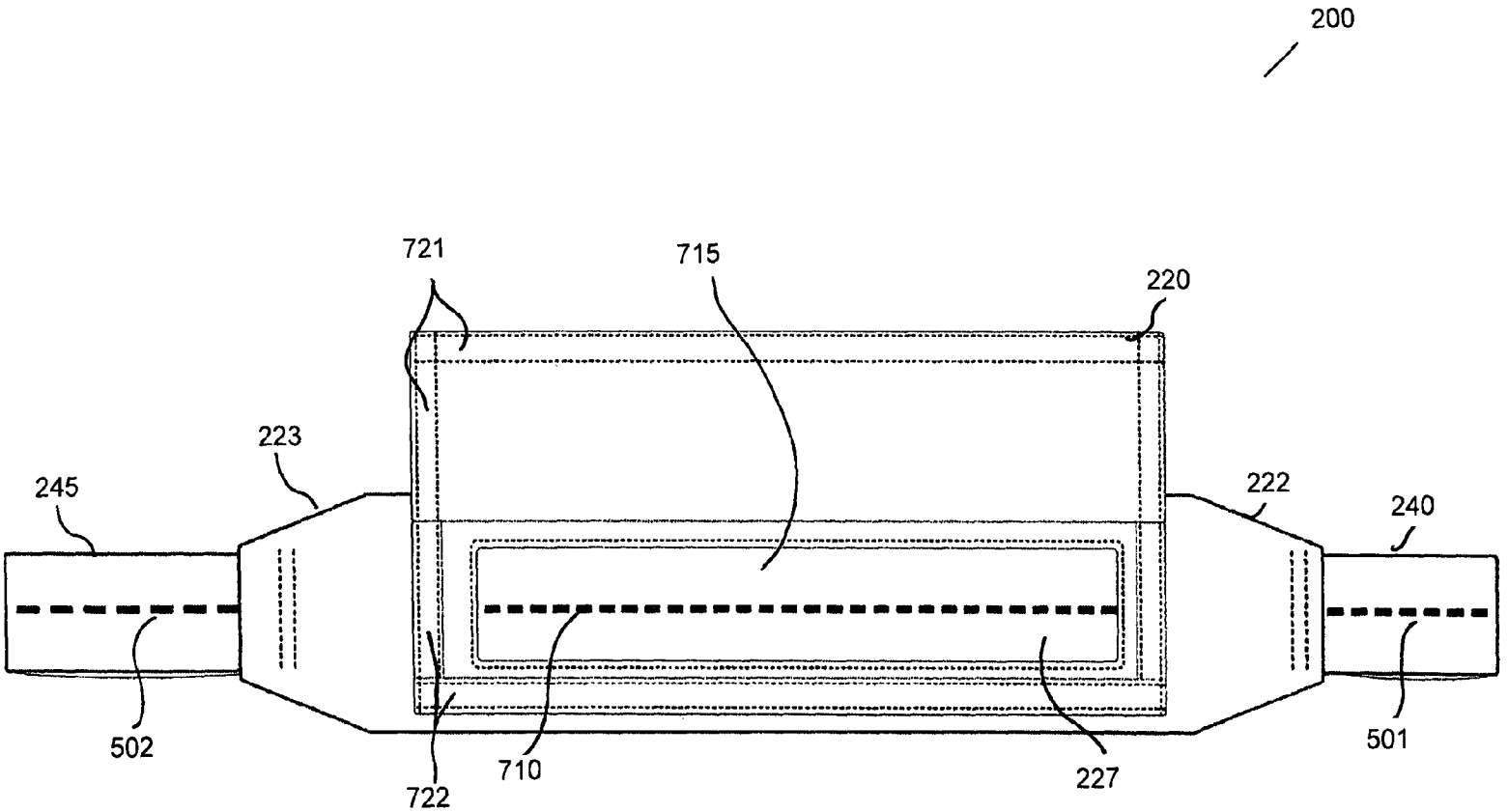
FIG. 7 illustrates a top view of viewable shock absorbing pack for a lanyard with a top cover opened according to one embodiment of the invention.

In one embodiment of the invention, the shock absorbing view pack 200 includes a first end 222 connected around a portion of a lanyard webbing portion 240 and a second end 223 connected around a portion of a lanyard webbing portion 245 and a second end 223. In one example, the top 221 of the shock absorbing view pack 200 includes a top cover 220 that is removable from a portion of the top 221. In one example, the top cover 220 is attached with hook and loop fasteners that connect with hook and loop fasteners connected to s portion of the top 221 that surround the inspection window 227 (FIG. 7).

In one example, the shock absorbing view pack 200 includes a second inspection window 225 that provides viewing of the absorption portion 230 of the lanyard disposed within the shock absorbing view pack 200. In one embodiment of the invention, the first end 222 is connected around a portion of the lanyard webbing portion 240 via multiple stitching portions and the second end 223 is connected around the portion of a lanyard webbing portion 245 via multiple stitching portions. In this embodiment of the invention, the multiple stitching portions may comprise heavy duty nylon or similar stitching for providing a dust and foreign material proofing portion that prevents entry of the dust and foreign material entering the lanyard portion enclosed by the shock absorbing view pack 200.

In one example, the multiple stitching portions around both ends 222 and 223 provide water proofing for preventing liquids form entering the lanyard portion enclosed by the shock absorbing view pack 200. In one example, the multiple stitching of the ends 222 and 223 to each respective lanyard portion 240 and 245 provide for a permanent attachment of the material cover 210 to the shock absorbing view pack 200. As the ends 222 and 223 are sealed, the shock absorbing view pack 200 provides a benefit over traditional clear packs that are open at both ends so that liquid and other debris are prevented from entering the absorption portion 230 of the lanyard.

Figure 3:
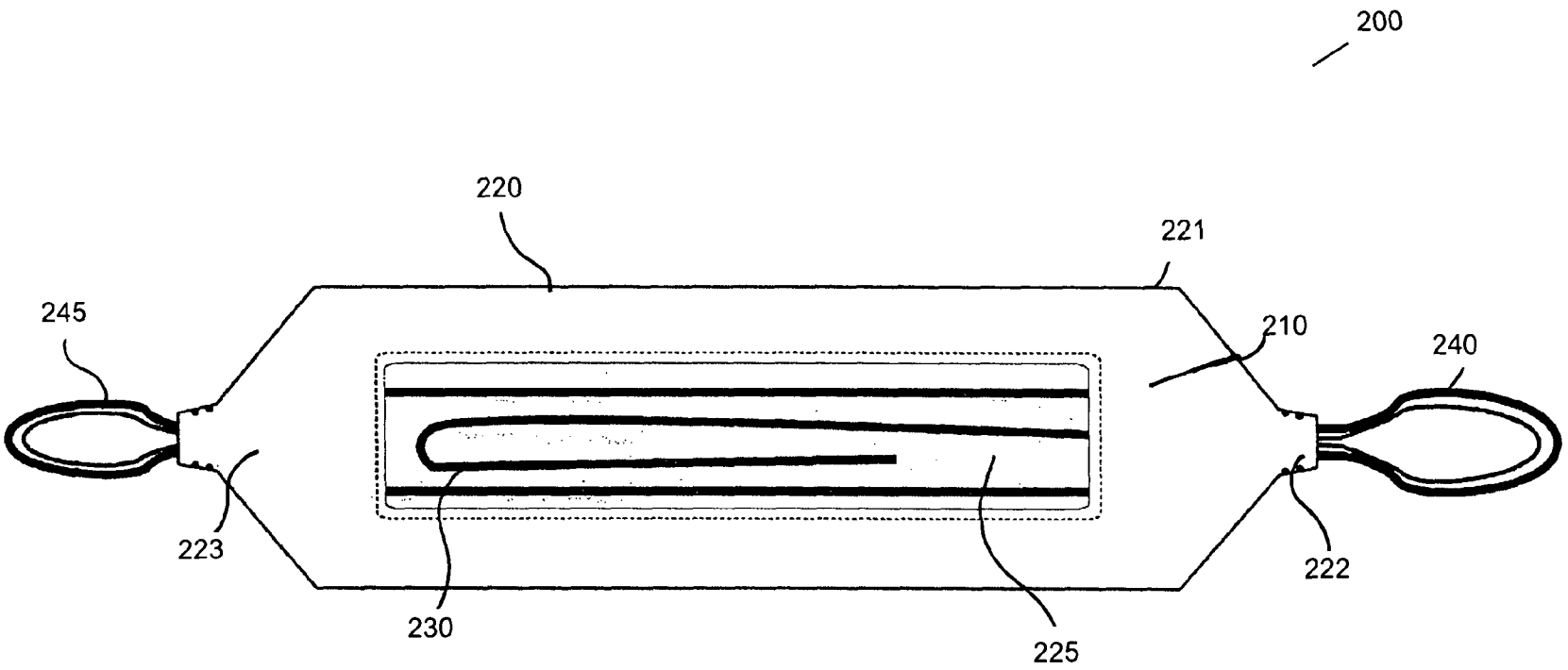
FIG. 3 illustrates a front view of viewable shock absorbing pack for a lanyard according to one embodiment of the invention.

FIG. 3 illustrates a front view of the shock absorbing view pack 200. As illustrated, the second inspection window 225 on the front of the shock absorbing view pack 200 provides for inspection of the absorption portion 230 of the lanyard disposed within the shock absorbing view pack 200.

Figure 4:
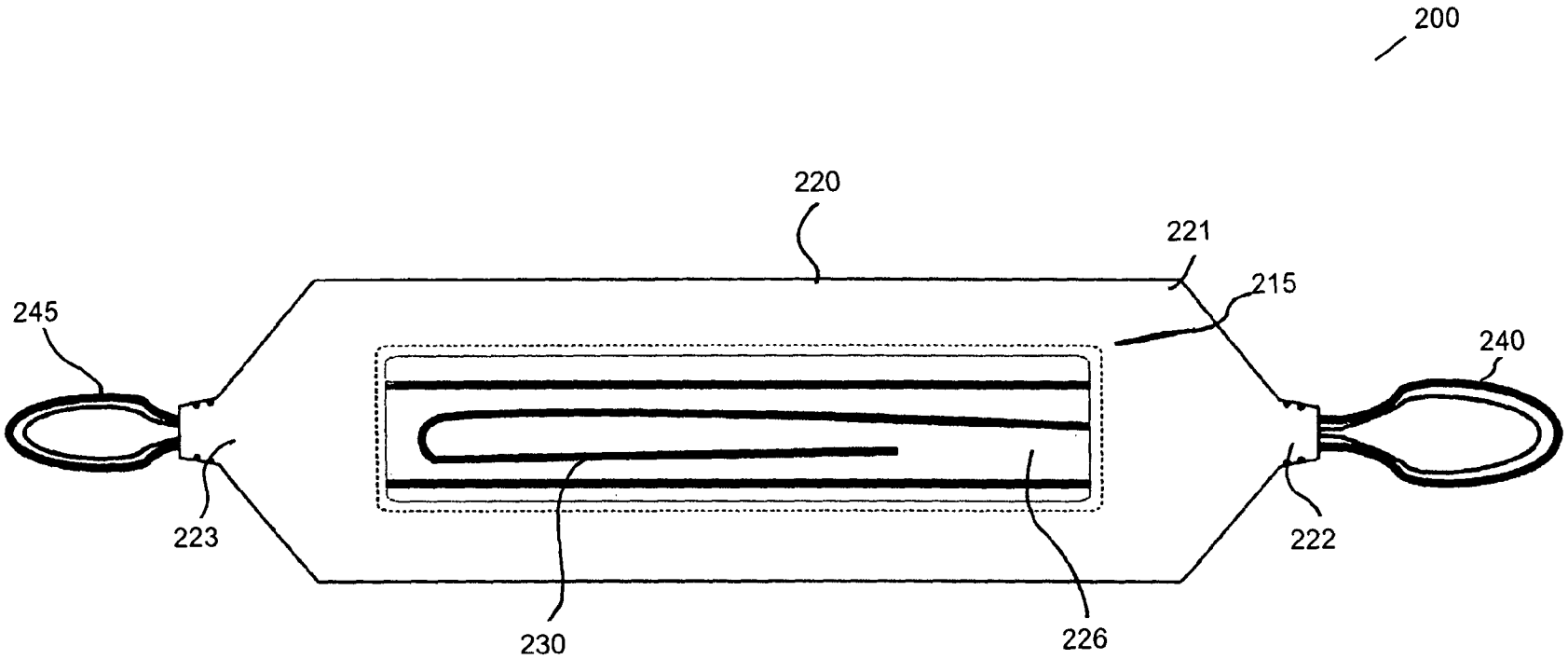
FIG. 4 illustrates a rear view of viewable shock absorbing pack for a lanyard according to one embodiment of the invention.

FIG. 4 illustrates a rear view of viewable shock absorbing pack 200 for a lanyard according to one embodiment of the invention. As illustrated, a third inspection window 226 on the rear side 215 of the material cover 210 provides for inspection of the absorption portion 230 of the lanyard disposed within the shock absorbing view pack 200.

In one example, the first inspection window 227, the second inspection window 225 and the third inspection window 226 may be made of a see through material, such as clear polyvinyl chloride (PVC) or similar materials. Unlike traditional clear pack lanyards that often crack or break off due to sun light exposure, the shock absorbing view pack 200 comprises the material cover 210 to protect the see through material.

Figure 5:
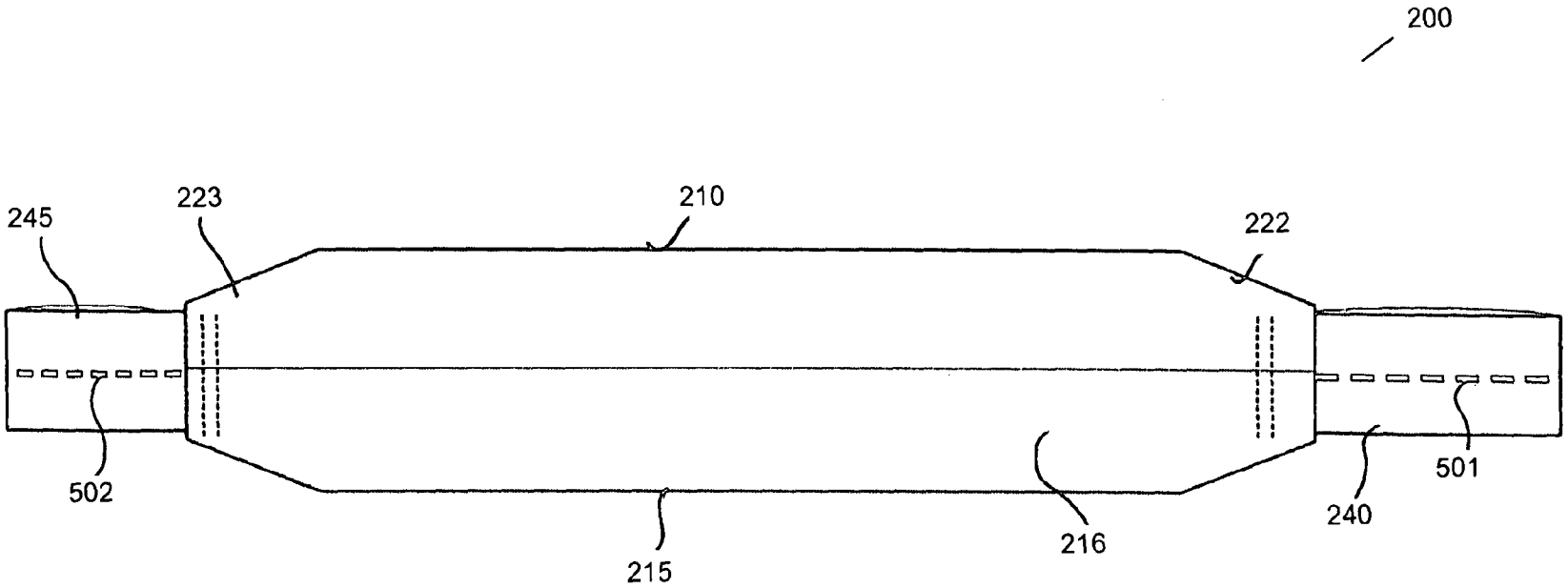
FIG. 5 illustrates a bottom view of viewable shock absorbing pack for a lanyard according to one embodiment of the invention.

FIG. 5 illustrates a bottom view of viewable shock absorbing pack 200 for a lanyard according to one embodiment of the invention. In one example, the bottom material side 216 does not include an inspection window. In another example, the bottom material side 216 includes an inspection window (not shown). In one embodiment of the invention, stitching 501 is coupled to the lanyard webbing portion 240 and stitching 502 is coupled to the portion of a lanyard webbing portion 245. In one example, the stitching 501 and 502 are centered on the respective lanyard webbing portions 240, 245. The stitching 501 and 502 may be used for inspecting the integrity of the lanyard.

Figure 6:
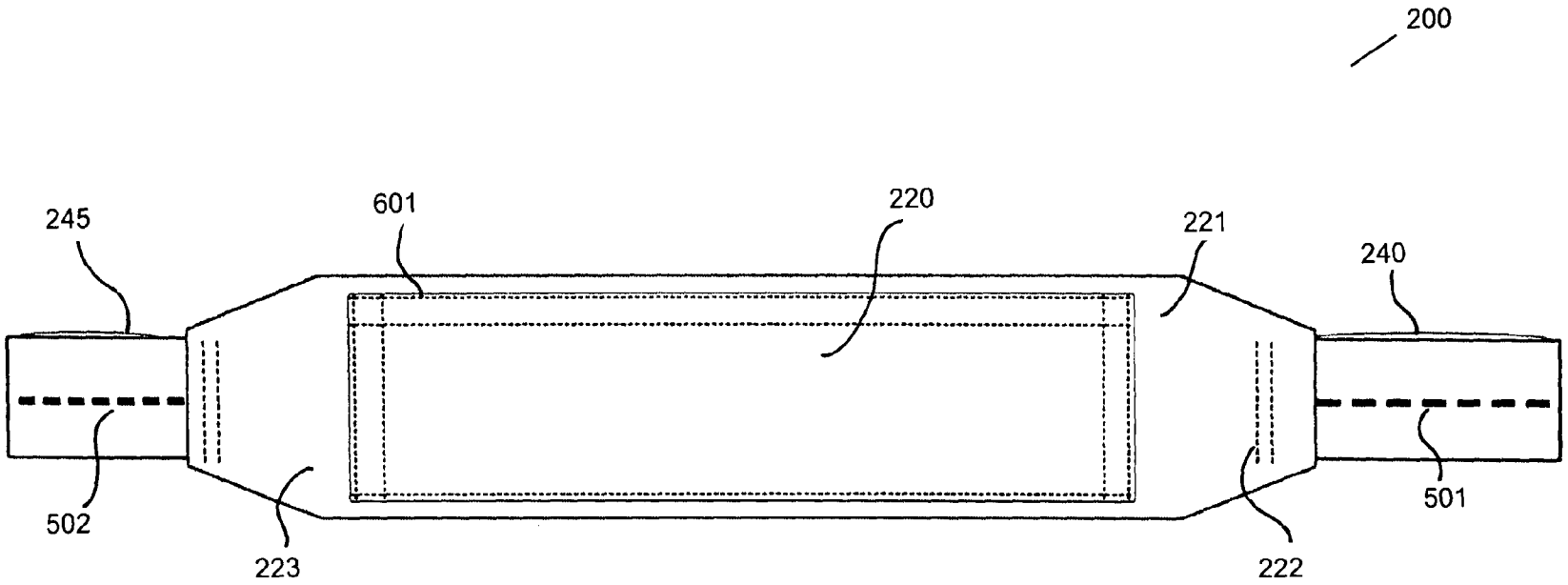
FIG. 6 illustrates a top view of viewable shock absorbing pack for a lanyard with a top cover closed according to one embodiment of the invention.

FIG. 6 illustrates a top view of viewable shock absorbing pack 200 for a lanyard according to one embodiment of the invention showing the top cover 220 in a closed state. As shown, the top 221 of the shock absorbing view pack 200 includes a top cover 220 that is removable from a portion of the top 221. In one example, the top cover 220 is secured to the top 221 at the edge 601 via stitching. In other examples, the top cover 220 is formed on the top 221 and may be reinforced on the edge 601 via stitching or other similar techniques.

FIG. 7 illustrates a top view of viewable shock absorbing pack 200 for a lanyard according to one embodiment of the invention showing the top cover 220 in an opened state. Portions 721 and 722 include fasteners, such as hook and loop fasteners, to close and open the top cover 220. In one example, inspection window 227 provides for inspection of a top portion of the absorption portion 230 of the lanyard, and in particular, the stitching 710 coupled to the lanyard. In one example, upon viewing the stitching 710, a user may determine whether the lanyard needs replacing based on the condition of the stitching 710 (e.g., stretched out, frayed, broken, etc.). In one embodiment of the invention, a portion 715 coupled to the absorption portion 230 of the lanyard may include inspection and safety instructions or a warning label.

It should be noted that while the inspection windows 225, 226 and 227 are shown, other orientations, sizes, shapes and positions of the inspection windows may be incorporated into the shock absorbing view pack 200 embodiments and examples. For example, the inspection windows may have any type of shape, such as rectangular, oval, square, polygonal, etc. Any number of inspection windows may be incorporated into the shock absorbing view pack 200 embodiments, such as 1, 2, 3, 4, 5, etc. In other embodiments of the invention, the top cover 220 may not be included. In still other embodiments of the invention, other covers may be included for any or all of the inspection windows.

Figures 8A, 8B, 8C:
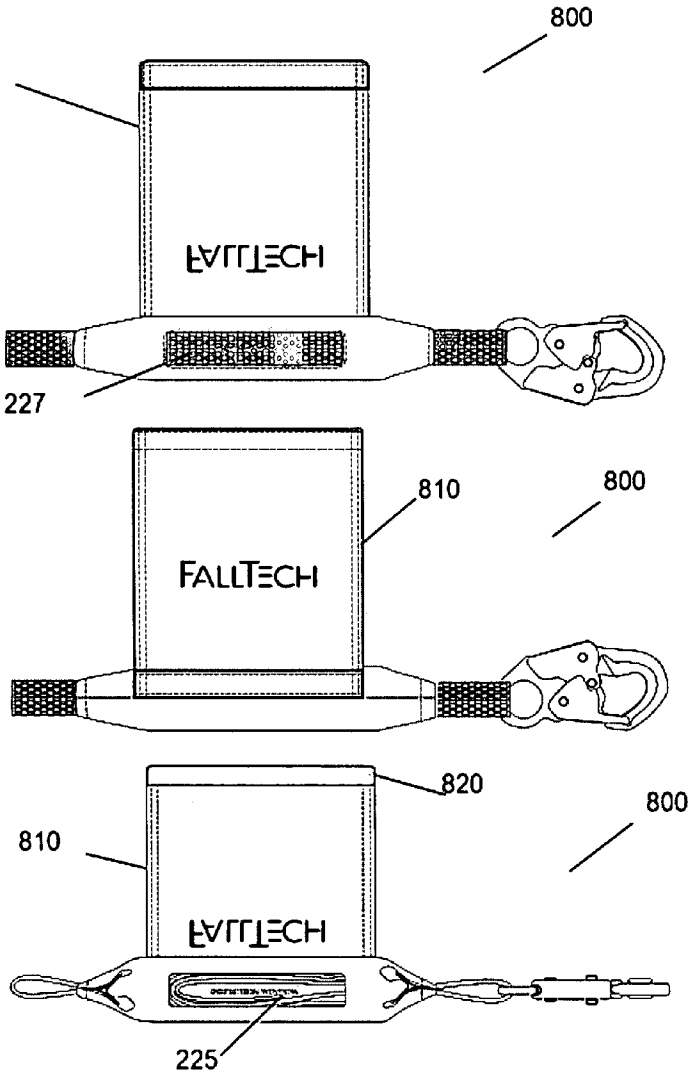
FIG. 8A-C illustrates another embodiment including a wrap-around cover for a viewable shock absorbing pack for lanyard according to one embodiment of the invention.

FIGS. 8A-C illustrate an embodiment including a wrap-around cover 810 for a viewable shock absorbing pack 800 for a lanyard according to one embodiment of the invention. In one embodiment, instead of the top cover 220, a wrap-around cover 810 wraps around the body and covers all of the shock absorbing portion. In one embodiment, the wrap-around cover 810 is clear so a user may see through the wrap-around cover 810. In another embodiment, only a portion of the wrap-around cover 810 is clear. In one embodiment, the wrap-around cover 810 includes a fastener portion 820 that may comprise hook and loop fasteners, snaps, or other appropriate fastening means.

The above-described embodiments and examples overcome the shortcomings of traditional lanyards and clear packs. The embodiments and examples of the invention provide an integrated material cover 210 that provides comfort and protection from impact, along with providing a barrier for dirt, water, etc. from entering the shock absorbing view pack 200 embodiments. Additionally, the shock absorbing view pack 200 embodiments provide protection to the inspection windows and rest of the body of the shock absorbing view pack 200 from damage from elements and sun light.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An apparatus comprising:

a lanyard;

a shock absorbing view pack permanently coupled with a material cover, the shock absorbing view pack including a first pack end portion and a second pack end portion, wherein the first pack end portion surrounds a first portion of the lanyard, and the second pack end portion surrounds a second portion of the lanyard; and a first inspection window included on a top side of the shock absorbing view pack, the first inspection window is configured as a portion of the material cover for providing an internal view of an absorption portion of the lanyard that is sealed by the shock absorbing view pack, a second inspection window is included on a front side of the shock absorbing view pack, and a third inspection window is included on a rear side of the shock absorbing view pack, wherein the first inspection window, the second inspection window and the third inspection window provide for inspection of the absorption portion of the lanyard sealed within the shock absorbing view pack, the first pack end portion and the second pack end portion are each configured to seal the shock absorbing view pack to prevent foreign material from entering the absorption portion of the shock absorbing view pack, and the first inspection window, the second inspection window and the third inspection window are each made of a clear polyvinyl chloride material.

2. The apparatus of claim 1, further comprising:

a removable top cover coupled over the first inspection window, wherein the removable top cover is configured to removably cover the first inspection window.

3. The apparatus of claim 2, wherein the removable top cover attaches to the top side of the shock absorbing view pack with hook and loop fasteners.

4. The apparatus of claim 3, wherein the removable top cover overlays the first inspection window, and a product warning label is viewable through the first inspection window.

5. The apparatus of claim 1, wherein the material cover is configured to provide protection from injury.

6. The apparatus of claim 1, wherein the lanyard includes particular stitching material coupled to webbing, and the stitching material is configured to indicate integrity of the lanyard.

7. The apparatus of claim 6, wherein the first pack end and the second pack end are waterproof and prevent water from entering an internal portion of the shock absorbing view pack.

8. A fall protection assembly comprising:

a lanyard including a shock absorption portion;

a shock absorbing view pack permanently coupled with a material cover and the lanyard, the shock absorbing pack including a first inspection window included on a top side of the shock absorbing view pack, a second inspection window is included on a front side of the shock absorbing view pack, and a third inspection window is included on a rear side of the shock absorbing view pack, the shock absorbing view pack including a first pack end portion and a second pack end portion, wherein the first pack end portion surrounds a first portion of the lanyard, and the second pack end portion surrounds a second portion of the lanyard, and the first inspection window is configured as a portion of the material cover to provide an internal view of the shock absorption portion of the lanyard;

a first lanyard coupler coupled to a first end of the lanyard in proximity to the first pack end portion of the shock absorbing pack; and a second lanyard coupler coupled to a second end of the lanyard, wherein the second pack end portion of the shock absorbing pack is coupled to another portion of the lanyard, and the first pack end portion and the second pack end portion are each configured to seal the shock absorbing view pack to prevent foreign material from entering the shock absorption portion sealed within the shock absorbing view pack, and the first inspection window, the second inspection window and the third inspection window are each made of a clear polyvinyl chloride material.

9. The fall protection assembly of claim 8, wherein the first inspection window provides a view of the shock absorption portion of the lanyard that is sealed within the shock absorbing view pack.

10. The fall protection assembly of claim 9, wherein the first pack end portion of the shock absorbing view pack is sealed and the second pack end portion of the shock absorbing view pack is sealed.

11. The fall protection assembly of claim 10, wherein the first pack end portion and the second pack end portion of the shock absorbing view pack are waterproof and prevent water from entering an internal portion of the shock absorbing view pack.

12. The fall protection assembly of claim 8, further comprising:

a removable top cover coupled over the first inspection window, wherein the removable top cover is configured to removably cover the first inspection window.

13. The fall protection assembly of claim 12, wherein the removable top cover overlays the first inspection window, and a product warning label is viewable through the first inspection window.

14. The fall protection assembly of claim 8, wherein the material cover is configured to provide protection from injury.

* * * * *